US007318476B2

(12) United States Patent
Ayres

(10) Patent No.: US 7,318,476 B2
(45) Date of Patent: Jan. 15, 2008

(54) AUTOMATIC CHEMICAL TREATMENT SYSTEM WITH INTEGRAL FLUSH FLUID DISPENSER

(76) Inventor: Robert M. Ayres, 63 Buckhorn, Spring, TX (US) 77381

( * ) Notice: Subject to any disclaimer, the term of this patent is extended or adjusted under 35 U.S.C. 154(b) by 235 days.

(21) Appl. No.: 10/990,617

(22) Filed: Nov. 16, 2004

(65) Prior Publication Data

US 2006/0102355 A1 May 18, 2006

(51) Int. Cl.
*E21B 37/06* (2006.01)

(52) U.S. Cl. ..... 166/310; 166/90.1; 166/53; 166/304; 166/902

(58) Field of Classification Search ..... 166/53, 166/90.1, 304, 310, 902, 75.12
See application file for complete search history.

(56) References Cited

U.S. PATENT DOCUMENTS 3,053,320 A * 9/1962 Steincamp ..... 166/68
4,064,936 A 12/1977 McClure
4,436,148 A 3/1984 Maxwell
4,830,112 A 5/1989 Erickson
5,209,298 A 5/1993 Ayres
5,209,300 A 5/1993 Ayres
2002/0027002 A1* 3/2002 Carmody et al. ..... 166/66

* cited by examiner

*Primary Examiner*—David Bagnell
*Assistant Examiner*—Robert Fuller
(74) *Attorney, Agent, or Firm*—Richard A. Fagin

(57) ABSTRACT

A wellbore chemical treating system includes a pressure vessel for containing a treating chemical. The pressure vessel is closed to atmospheric pressure. A first controllably operated valve is disposed in direct fluid communication between an outlet of the pressure vessel and a well for selectively controlling the flow of the chemical from the pressure vessel to the well. A pressurized gas is disposed in the pressure vessel wherein the pressure exerted by the pressurized gas causes the chemical to flow from the pressure vessel to the well through the first valve when the first valve is opened. A second controllably operated valve is disposed in fluid communication between the well and an outlet of a fluid tank for selectively controlling flow of fluid in the tank to the well. The fluid tank is replenished by fluid produced from the well. The system includes a controller for selectively operating the first valve and the second valve.

19 Claims, 1 Drawing Sheet

AUTOMATIC CHEMICAL TREATMENT SYSTEM WITH INTEGRAL FLUSH FLUID DISPENSER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF INVENTION

1. Field of the Invention

The invention relates generally to the field of chemical treatment systems for use with hydrocarbon producing wells. More specifically, the invention relates to chemical treatment systems which inject "pre flushed" or diluted treatment chemicals into the well.

2. Background Art

In wellbores drilled through the Earth and then used for production of hydrocarbons, a pipe or casing is disposed in the wellbore from the Earth's surface to the bottom of the well. The casing serves to hydraulically isolate the various Earth formations penetrated by the wellbore and to provide the wellbore with a degree of mechanical stability. Typically a tubing string, which is a pipe of considerably lesser diameter than the casing, is positioned within the well casing. The purpose of the tubing string is to enable produced fluids to move to the Earth's surface at greater velocity than would be possible within the casing. The hydrocarbons, and in many cases a considerable amount of connate water, enter the tubing through perforations located at the lower end of the casing, travel through the tubing, to a wellhead at the Earth's surface. In some wells, where the natural fluid pressure in the Earth's subsurface is not sufficient to lift the produced fluids to the Earth's surface, the fluids are pumped to the surface with a "sucker rod" pump or with a downhole electrical submersible pump.

At the Earth's surface, various production equipment directs the produced fluids to holding tanks and/or to a pipeline. The production equipment typically comprises tubing, valves, piping, and other components. The produced fluids typically contain numerous compounds which adversely affect the production equipment. For example, paraffins and water/oil emulsions can coat well production equipment and can eventually plug off the tubing and/or plug the perforations in the casing. In addition, chemical reactions between the produced fluids and metallic equipment can cause scale to be formed on the well production equipment, and some compounds in the produced fluids can corrode the well production equipment.

Various techniques are known in the art to treat these well conditions to extend the useful life of the well production equipment, tubing and casing. In wells susceptible to paraffin build-up, for example, "treater trucks" or "hot oil trucks" are regularly dispatched to pump heated oil and/or heated water into the well. The heated oil and/or water is pumped into the well through the annular space between the tubing and the casing, travels down through the annulus to melt the paraffin deposits in the well production equipment, and the returns to the surface through the tubing. In wells susceptible to corrosion and scale problems, high pressure injection treater trucks pump batches of chemicals into the well to chemically remove the scale, and to inhibit the causes of corrosion. All of these techniques require regular maintenance services which are costly and which do not continuously treat the well. Treater truck or batch treatment of wells is less efficient than continuous treatments because more chemicals are typically injected in batch treatment operations.

To avoid inefficiencies associated with treater truck maintenance of hydrocarbon producing wells, it is known in the art to use mechanical pumps to inject chemicals into a well. Typically, mechanical pumps are supplied from a storage tank which holds the chemicals. The mechanical pumps and storage tanks are located adjacent the well for several reasons, such as for reducing the length of power cable or piping that connects the pump to a power source such as electricity or natural gas. The tanks are located above the pump and the chemical is gravity fed to the intake port of the pump. The tanks include a vent at the upper end of the tank to prevent a vacuum from developing in the tank as the pump draws chemical from the tank. In addition, the vent releases excess pressure within the tank caused by thermal expansion of the chemical. Such thermal expansion can cause the chemical vapors to be released into the environment through the vent. In addition, thermal expansion can cause the chemical to be ejected through the vent or through the sight glass used to indicate the chemical level in the tank. In either event, chemical vapors or the chemical fluids are released in an uncontrolled manner and can pose a hazard to personnel and to the environment.

The mechanical pumps used in typical chemical injection systems are powered by electricity or gas and include numerous moving components. It is customary to inspect these pumps on a regular basis, sometimes daily, to verify the operability of the pumps. Because the chemical is gravity fed to the intake of the chemical pump, sediment in the tank or the chemical settles toward the pump intake and can interfere with the operation of the pump In addition, the presence of an air bubble in the intake line may impede the operation of the pump because of a vapor lock. In such event, maintenance personnel routinely open a bleeder valve on the pump and release chemical from the pump until the air bubble has been cleared. This practice is undesirable because it releases chemical into the environment. An additional consideration with respect to venting a chemical pump system to the atmosphere is introduction of moisture into the chemical system, which may condense and foul the chemical.

One device known in the art for providing controllable, continuous chemical treatment for well production equipment is disclosed in U.S. Pat. No. 5,209,300 issued to Ayres. An apparatus and method described in the Ayres '300 patent include a vessel which holds the chemical and a pressurized gas which exerts a pressure on the chemical. A pressure regulator and a valve selectively control the injection of the chemical into the well as the pressurized gas urges the chemical out of the vessel. The pressurized gas drives the chemical through the regulator, valve, and into the well without venting the chemical or pressurized gas into the ambient environment. The apparatus described in the Ayres '300 patent is adapted to inject chemicals into the well in essentially undiluted form. As will be explained below, in certain cases it is desirable to pump undiluted chemicals into a wellbore and follow such injection with a water flush.

So called "batch treatment" is among the more widely used methods used for downhole treatment of sucker rod pumped wells. A treater truck is dispatched to the well. The chemical is placed into the annulus in undiluted form, and is followed by an "overflush" of water to assure proper treatment of the well, because sucker rod pumped wells are susceptible to "pump off", whereby the pump is operated at such a rate as to essentially remove all the fluid from the well down to the level of the pump In such cases, there is substantially no fluid to dilute and disperse the treating chemical, making the treatment less effective. The overflush is intended to provide sufficient dispersing fluid for the treatment chemical so that the chemical can reach the bottom of the well. The chemical would otherwise need to travel the entire distance from the surface in undiluted form, often against upward flow of gas in the well. Typically, the chemical can dry out inside the well before ever reaching the bottom when injected in undiluted form. The overflush water, however, is typically taken from storage tanks located near the well for storing, and subsequent environmentally safe disposal, of connate water that is produced from the well along with oil and gas. The water in the tanks is often contaminated with high levels of oxygen and sulfate reducing bacteria. When reinjected into a well, such cross-inoculation of contaminates lessens the effectiveness of typical corrosion inhibitor chemicals, among other problems. The truck batch treatment process in effect provides a recirculation of the corrosive materials through the entire well, and any other wells sharing the same surface production equipment, on a periodic basis. Some method is needed to break this cycle so that the fluid used to protect the system is not part of the problem.

SUMMARY OF INVENTION

One aspect of the invention is a wellbore chemical treating system. A system according to this aspect of the invention includes a pressure vessel for containing a treating chemical. The pressure vessel is closed to atmospheric pressure. A first controllably operated valve is disposed in fluid communication between an outlet of the pressure vessel and a well for selectively controlling the flow of the chemical from the pressure vessel to the well. A pressurized gas is disposed in the pressure vessel wherein the pressure exerted by the pressurized gas causes the chemical to flow from the pressure vessel to the well through the first valve when the first valve is opened. A second controllably operated valve is disposed in fluid communication between the well and an outlet of a fluid supply tank for selectively controlling flow of fluid in the tank to the well. The system includes a controller for selectively operating the first valve and the second valve. The fluid tank is replenished by fluid produced from the well.

Other aspects and advantages of the invention will be apparent from the following description and the appended claims.

DETAILED DESCRIPTION

Figure 1:
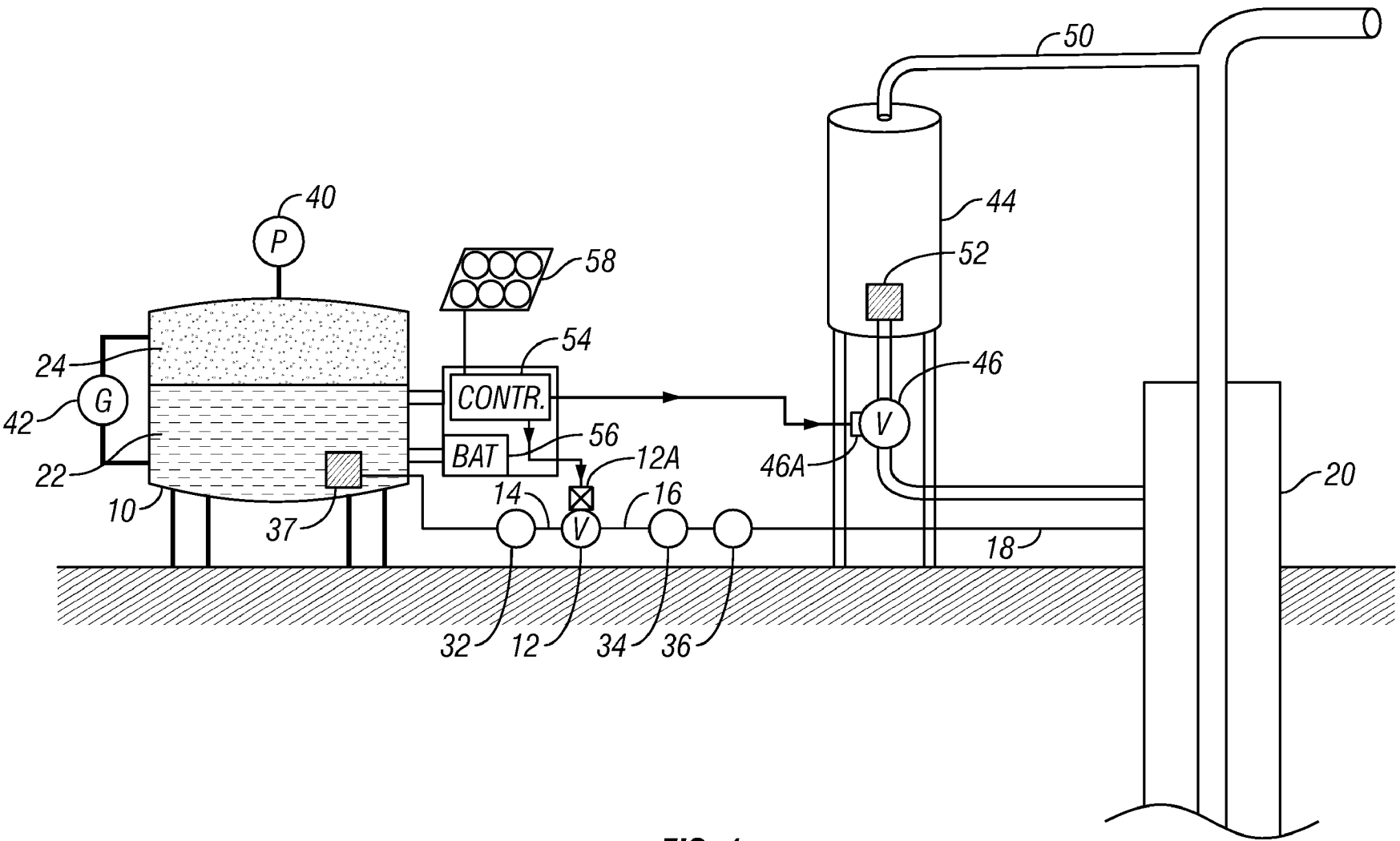
FIG. 1 shows an automatic treatment system according to one embodiment of the invention.

An example embodiment of a chemical treating system according to the invention is shown schematically in FIG. 1. A chemical dispenser vessel 10, substantially as described in U.S. Pat. No. 5,209,300 to Ayres, incorporated herein by reference, includes a container which is capable of holding an internal pressure without failure. The vessel 10 is distinguishable from containers such as tanks which may only be designed to withstand the hydrostatic pressure exerted by fluid in the tank. Preferably, the vessel 10 is made from glass, carbon or composite fiber reinforced plastic, from stainless steel, or from any other material which is resistant to degradation induced by chemicals and corrosive gases. Alternatively, the vessel 10 can include an inner lining (not shown) resistant to chemical attack. A first control valve 12, which in the present embodiment can be actuated by an actuator 12A, which can be a solenoid or the like, has an inlet end 14 in fluid communication with the interior of the vessel 10. An outlet end 16 of the valve 12 is connected to one end of a fluid injection line 18. The other end of the fluid injection line 18 is coupled to a hydrocarbon producing well 20. Alternatively, the actuator 12A can be a motor/gear set.

Although the well 20 is typically a hydrocarbon producing well, the present invention is useful in other wells relating to the production of hydrocarbons such as injection wells used in enhanced recovery operations. As used throughout this disclosure, the terms "well" and "hydrocarbon producing well" can include all wells directly or incidentally associated with the production from or injection of fluids into subsurface Earth formations.

A treating chemical 22 is typically contained in the vessel 10 in liquid form. It is within the scope of the invention that the chemical 22 can comprise any liquid compound or material that can be injected into a well. As representative examples, without limiting the scope of the invention, the chemical 22 can comprise chemicals generally identified as corrosion/scale inhibitors, water clarifiers, demulsifiers, and other chemicals which inhibit the formation of chemical, organic, or metallic compounds in hydrocarbon producing wells.

As shown in FIG. 1, a pressurized gas 24 is also disposed in the vessel 10. The pressurized gas 24 preferably includes one or more chemically inert gases, which do not chemically react with the chemical 22. The gas 24 may comprise readily available gases such as nitrogen, helium, argon or carbon dioxide. The pressurized gas 24 is initially charged to a pressure which is less than the condensation pressure for such gas. The condensation pressures are commonly known for each gas, and are not exceeded within the vessel 10 to prevent the mixing, in the liquid phase, of the pressurized gas 24 with the chemical 22. In addition, the density of pressurized gas 24 is preferably less than the density of the chemical 22 so that the chemical 22 is concentrated toward the bottom end of vessel 10, and the pressurized gas 24 is concentrated toward the upper end of the vessel 10. As shown in FIG. 1, the pressurized gas 24 is in contact with the chemical 22 and pressurizes the chemical 22 to the same pressure as that of the pressurized gas 24.

As shown in FIG. 1, a pressure regulator 32 can be installed between the outlet of the vessel 10 and an inlet 14 of the control valve 12. The pressure regulator 32 controls the pressure of the chemical 22 which is communicated to the inlet 14 of the valve 12. For example, if the pressure of the pressurized gas 24 and the chemical 22 in the vessel 10 is 500 pounds per square inch (psi), the regulator 32 can reduce the pressure of the chemical 22 at the inlet 14 of the valve 12 to a selected pressure that is greater than the well 20 pressure. As a representative example, if the pressure of the well 20 is 90 psi, and the desired pressure differential across the valve 12 is 10 psi, then the regulator 32 can be set to reduce the pressure of the chemical 22 from 500 psi to about 100 psi. The regulator 32 should not reduce the pressure of the chemical 22 below the pressure in well 20 because this would prevent the chemical 22 from entering the well 20. To prevent the accidental or inadvertent backflow of well fluids into fluid line 18, a check valve 36 can be installed in the line 18. The control of the pressure differential across valve 12 can be important because the flow rate through certain types of valves is dependent on the size of the valve orifice and the pressure differential between the valve inlet and outlet ports. As the pressure differential across a valve increases, the flow rate through the valve will typically increase unless the valve is designed to maintain a steady flow rate in response to varying flow pressures. As steady rate valves are more expensive than other valves which do not have a pressure compensation feature, the pressure regulator 32 is an inexpensive solution for controlling the flow rate of chemical through the valve 12. The regulator 32 is also useful because the use of the regulator 32 in conjunction with the valve 12 permits the precise metering of small quantities of the chemical 22.

In some embodiments, such as shown in FIG. 1, a second regulator 34 can be located between the valve 12 and the well 20. The valve 12, the first regulator 32, and the second regulator 34 are each in fluid communication with the interior of the vessel 10 and the well 20. In the present embodiment, any pressure fluctuations in the vessel 10 and in the well 20 are thus isolated from the valve 12. Consequently, the pressure differential acting across the valve 12 can be precisely controlled, thereby permitting effective control over the flow rate of the chemical 22 through the valve 12. The present embodiment permits the flow rate of the chemical 22 to be controlled to a very precise rate even substantially less than one one-thousandth of a gallon per day.

In operation, the valve 12 is initially closed to prevent the release of the chemical 22 from the vessel 10. The valve 12 is then selectively opened and the pressurized gas 24 urges the chemical 22 through the first regulator 32, the valve 12, the second regulator 34 through the line 18, and into the well 20.

Preferably, the opening of the valve 12 is timed to selectively control the flow of chemical 22 into well 20. The valve 12 can be operated at particular open durations to selectively increase or decrease the amount of the chemical 22 injected into the well 20. The precise injection amount of the chemical 22 accomplishes several objectives. Certain wells may require large volumes of chemicals to accomplish the desired function. Other wells may require only relatively small quantities of chemicals to accomplish the desired results. For example, certain wells may require only a fraction of a gallon per day to accomplish the desired result, and the injection of additional chemicals is unnecessary to the operation of the well. If more chemical than required is injected into the well, then the excess chemical is superfluous to the operation of the well and results in additional cost to the operator. The present invention selectively controls the flow amount of the chemical 22 and eliminates unnecessary chemical use.

The apparatus of the present invention can be configured to control the flow of chemical 22 by selecting the operating time and frequency of operation of the valve 12 from any chemical amount, ranging from essentially a continuous discharge of the chemical 22 from the vessel 10, to any amount even as small as one one-thousandth of a gallon per day or less.

As previously explained, the check valve 36 may also be installed in the injection line 18 to prevent the backflow of fluids in the well 20 into the valve 12 or the vessel 10. This feature is desirable because a well operator could accidentally pressurize well 20 to a pressure higher than that of the chemical 22 in the vessel 10. Alternatively, this function could be incorporated into the design of the valve 12.

In some embodiments, a float 37 or similar means can be located in the vessel 10 to prevent the pressurized gas 24 from exiting the vessel 10. The float 37 has a density less than that of the chemical 22 and is buoyant therein. As the level of chemical 22 is lowered in the vessel 10 by releasing the chemical 22 through the valve 12, the float 37 will be lowered in the vessel 10. When the float 37 reaches a selected position within the vessel 10, the float 37 seals the outlet of the vessel 10 to prevent the release of the pressurized gas 24 from the vessel 10. This function can be performed other than by using the float 37. For example, a liquid level gauge 42 could be used to indicate the level of the chemical 22 within the vessel 10 so that an operator could visually check the level of the chemical 22. In other embodiments, mechanical, electrical, or electronic equipment could be used to indicate the level of the chemical 22 within the vessel 10 or, alternatively, to seal the outlet when the level of the chemical 22 in the vessel is lowered to a certain position. A pressure gauge 40 can be attached to vessel 10 to measure the pressure of the pressurized gas 24. The gauge 42 can be attached to the vessel 10 for measuring the quantity of the chemical 22 in the vessel 10. The gauge 42 can comprise many different embodiments such as sight glasses, electromagnetic switches, and other devices well-known in the art. In addition, the gauge 42 could comprise a flow meter which measures the quantity of fluid flowing from the vessel 10 When the fluid quantity flowing from the vessel 10 is compared to the quantity of the chemical 22 initially installed in the vessel 10, the quantity of the chemical 22 in the vessel 10 at any point in time can be determined.

In the present invention, the control valve 12 can be operated electrically, such as by the actuator 12A. The actuator 12A can be operated by a controller 54 of any type known in the art, such as a programmable logic controller, for electronic control of operation of a process operating device. The controller 54 may be supplied with electrical power by a battery 56. The battery 56 may be recharged by a solar cell 58. The foregoing electrical power to operate the controller 54 and the actuator 12A are not intended to ultimately limit the scope of the invention, but are preferred for economy and reliability of operation.

The present invention includes a fluid storage tank 44. The fluid storage tank 44 receives produced fluid from the well 20 through a flowline 50 coupled to an outlet of the well 20. The fluid storage tank 44 is preferably made so that it can hold internal pressure equal to the pressure at the outlet of the well 20. As fluid is produced from the well 20, some of it will enter the flowline 50 and ultimately fill the tank 44. The fluid storage tank 44 may include at its discharge end a float 52 similar in operation to the float 37 on the vessel 10. The outlet of the fluid tank 44 is in hydraulic communication with the well 20 through a second control valve 46 operated by a motor/gear set 46A. It has been determined through experimentation with various types of valve actuators that using a motor/gear set to actuate the second valve 46 reduces the incidence of improper valve operation due to contamination of the valve from materials present in the fluidm produced from the well. A motor/gear set is also less susceptible to the valve 46 being improperly opened by high pressures extant on the outlet side of the valve 46. The motor/gear set 46A can also be operated by the controller 54. As will be explained below, when the valve 46 is operated, fluid in the tank 44 may flow into the well 20. By having equal pressure on the well 20 and the tank 44, fluid in the tank 44 may simply flow by gravity into the well 20.

In the present embodiment, the controller 54 may be programmed to operate the first control valve 12 to selectively discharge the chemical 22, and the control valve 46 for the fluid stored in the fluid storage tank 44 at selected times and durations. Operating the first control valve 12, as previously explained, causes injection of a selected amount of the chemical 22 into the well 20. At substantially the same time, operation of the second control valve 46 causes the contents of the fluid storage tank 44 to flow by gravity into the well 20. Thus, a chemical treatment is supplied to the well 20 that is already dispersed in fluid (which may include oil and/or water) prior to reaching the bottom of the well 20, in the event the fluid level in the well 20 is too low to properly disperse the chemical 22 by itself.

In some embodiments, the float 52 may include a switch (not shown separately) so that the controller 54 will not operate the valves 12, 46 if the level of water in the water tank 44 falls below a selected level. In some embodiments, the second valve 46 can be operated to discharge essentially the entire contents of the fluid storage tank 44 at each operation. In other embodiments, the second valve 46 can be operated to discharge a selected amount of the contents of the fluid storage tank 44. In other embodiments, the second regulator 34 and the check valve 36 may be omitted. Additionally, the controller 54 can be programmed to operate the first valve 12 and the second vale 46 with respect to any timing reference, such as during periods of time in which a pump (not shown) is operating to lift fluids out of the well 20, or at times during which the pump (not shown) is not operating. Alternatively, the controller 54 can be programmed to operate the valves 12, 46 simultaneously, or at different times from each other.

Embodiments of the invention provide a system for automatic chemical treatment of a well in which the treating chemical is pre-dispersed in a fluid obtainable from the well itself. Embodiments of the invention can provide properly dispersed treatment chemical for a well even in the event the well is "pumped off" (meaning that the fluid level is insufficient for a downhole pump to lift fluid to the Earth's surface).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wellbore chemical treating system, comprising:

a pressure vessel for containing a treating chemical, the pressure vessel closed to atmospheric pressure;

a first controllably operated valve in direct fluid communication between an outlet of the pressure vessel and a well for selectively controlling the flow of the chemical from the pressure vessel directly to the well;

a pressurized gas located in the pressure vessel wherein the pressure exerted by the pressurized gas causes the chemical to flow from the pressure vessel to the well through the first valve;

a fluid supply tank in communication with the well and configured to retain a same pressure as exists in the well;

a second controllably operated valve disposed between the well and an outlet of the fluid supply tank for selectively controlling flow of fluid in the tank to the well; and a controller for selectively operating the first valve and the second valve.

2. The system of claim 1 wherein the controller is adapted to cause the second valve to operate for a time sufficient to discharge substantially all the fluid in the tank.

3. The system of claim 1 wherein an inlet to the fluid tank is operably coupled to an outlet of the well so as to be refilled by fluid produced from the Earth's subsurface.

4. The system of claim 1 wherein at least one of the pressure vessel and the fluid tank includes a float operable to close an outlet of at least one of the pressure vessel and the fluid tank when a respective level of one of the chemical and the fluid therein falls below a selected level.

5. The system of claim 1 wherein the controller is configured to operate the first valve-and the second-valve substantially simultaneously.

6. The system of claim 1 wherein the controller is configured to operate the first valve and the second valve at different times from each other.

7. The system of claim 1 wherein the first-valve comprises a solenoid to effect operation thereof.

8. The system of claim 1 wherein the second valve comprises a motor/gear set to effect operation thereof.

9. A method for injecting treatment chemical in liquid form into a well, comprising:

applying compressed gas to the chemical to pressurize the chemical;

at selected times making an hydraulic connection directly between the pressurized chemical and an interior of the well, thereby enabling the pressurized chemical to flow into the well;

storing fluid produced from the well, the storing performed at a pressure extant on the well; and at selected times making an hydraulic connection between the stored, produced fluid and the well so that the produced fluid flows into the well by gravity.

10. The method of claim 9 further comprising reducing a pressure of the pressurized liquid to a selected amount above a pressure extant in the well.

11. The method of claim 9 wherein the selected times of making the hydraulic connection between the chemical and the well have a duration and frequency selected to inject a predetermined quantity of the chemical into the well.

12. The method of claim 9 further comprising determining an amount of the stored fluid and stopping the making the hydraulic connection between the stored fluid and the well when the amount of stored fluid falls below a selected threshold and if the hydraulic connection between the chemical and the well is being made at the same time, stopping the making thereof.

13. A method for injecting treatment chemical in liquid form into a well, comprising:

at selected times automatically causing the chemical to flow directly into the well;

storing fluid produced from the well at a pressure extant on the well; and at selected times automatically making an hydraulic connection between the stored, produced fluid and the well so that the produced fluid flows into the well by gravity.

14. The method of claim 13 further comprising reducing a pressure of the pressurized liquid to a selected amount above a pressure extant in the well.

15. The method of claim 13 wherein the selected times of injecting the chemical and making hydraulic connection to the well have a duration and frequency selected to inject a predetermined quantity of the chemical into the well.

16. The method of claim 13 further comprising determining an amount of the stored fluid and stopping the injecting the chemical and making the hydraulic connection when the amount of stored fluid falls below a selected threshold.

17. A method for injecting treatment chemical in liquid form into a well, comprising:

at selected times automatically causing the chemical to flow directly into the well; and at selected times automatically making an hydraulic connection between produced fluid from the well held at a pressure extant on the well, and to the well, so that the produced fluid flows into the well by gravity.

18. The method of claim 17 further comprising reducing a pressure of the pressurized liquid to a selected amount above a pressure extant in the well.

19. The method of claim 17 wherein the selected times of injecting the chemical and making hydraulic connection to the well have a duration and frequency selected to inject a predetermined quantity of the chemical into the well.

* * * * *